US006637238B2

(12) United States Patent
Grootjans

(10) Patent No.: US 6,637,238 B2
(45) Date of Patent: Oct. 28, 2003

(54) COMPRESSION APPARATUS FOR GASEOUS REFRIGERANT

(75) Inventor: Hendrik Frans Grootjans, Amsterdam (NL)

(73) Assignee: Shell Research Limited, London ( * ) Notice: Subject to any disclaimer, the term of this patent is extended or adjusted under 35 U.S.C. 154(b) by 0 days.

(21) Appl. No.: 10/149,537

(22) PCT Filed: Dec. 15, 2000

(86) PCT No.: PCT/EP00/12919

§ 371 (c)(1),
(2), (4) Date: Jun. 11, 2002

(87) PCT Pub. No.: WO01/44734

PCT Pub. Date: Jun. 21, 2001

(65) Prior Publication Data

US 2003/0000247 A1 Jan. 2, 2003

(30) Foreign Application Priority Data

Dec. 15, 1999 (EP) ..... 99310096

(51) Int. Cl.[7] ..... F25J 3/00
(52) U.S. Cl. ..... 62/613; 62/619; 62/510
(58) Field of Search ..... 62/613, 619, 640, 62/646, 570

(56) References Cited

U.S. PATENT DOCUMENTS 4,698,080 A 10/1987 Gray et al.
5,611,216 A 3/1997 Houser et al.
5,651,270 A 7/1997 Low et al.
5,737,940 A 4/1998 Houser et al.
5,791,159 A * 8/1998 Aicher et al. ..... 62/510
5,832,745 A 11/1998 Nagelvoort et al.
5,941,095 A * 8/1999 Gistau-Baguer ..... 62/613

OTHER PUBLICATIONS

H. Paradowski; D. Leroux; O. Sguera; R. Feresin: La liquéfaction des gaz associés >>, Seventh International Conference On LNG. May 15–19, 1983, XP002138034.

* cited by examiner

*Primary Examiner*—Ronald Capossela

(57) ABSTRACT

An apparatus for compressing gaseous refrigerant for use in a refrigeration circuit of a liquefaction plant, which refrigeration circuit has an inlet, a first outlet for refrigerant at low pressure, a second outlet for refrigerant at intermediate pressure, a third outlet for refrigerant at high pressure and a fourth outlet for refrigerant at high-pressure, which apparatus comprises a first and a second compressor, wherein the first compressor has a main inlet connected to the first outlet, a side-inlet connected to the third outlet and an outlet connected to the inlet of the refrigeration circuit, and wherein the second compressor has a main inlet connected to the second outlet, a side-inlet connected to the fourth outlet and an outlet connected to the inlet of the refrigeration circuit.

2 Claims, 1 Drawing Sheet

COMPRESSION APPARATUS FOR GASEOUS REFRIGERANT

BACKGROUND OF THE INVENTION

Field of the Invention

The present invention relates to an apparatus for compressing gaseous refrigerant for use in a refrigeration circuit of a liquefaction plant.

U.S. Pat. No. 4,698,080 discloses a liquefaction plant of the so-called cascade type having three refrigeration circuits operating with different refrigerants, propane, ethylene and methane. In the first two of these refrigeration circuits the natural gas is pre-cooled, and in the third refrigeration circuit the natural gas is liquefied.

In the first two refrigeration circuits, the propane circuit and the ethylene circuit, the refrigerant is compressed in an apparatus for compressing gaseous refrigerant to a refrigeration pressure and supplied to three heat exchangers in series, wherein in each heat exchanger the refrigerant is allowed to evaporate at a lower pressure in order to remove heat from the natural gas feed. The refrigerant is allowed to partly evaporate in the first heat exchanger at high pressure. The vapour part of the refrigerant at high pressure leaving the first heat exchanger is returned to the compression apparatus and the remaining liquid is allowed to partly evaporate at intermediate pressure in the second heat exchanger. The vapour part of the refrigerant at intermediate pressure leaving the second heat exchanger is returned to the compression apparatus and the remaining liquid is allowed to evaporate at low pressure in the third heat exchanger. The refrigerant at low pressure leaving the third heat exchanger is returned to the compression apparatus.

The third refrigeration circuit, the methane circuit, differs from the other two. A difference is that the natural gas that has been pre-cooled at liquefaction pressure is liquefied in a main heat exchanger by indirect heat exchange with natural gas. The natural gas used for liquefaction is obtained downstream of the main heat exchanger. Downstream of the main heat exchanger, the pressure of the liquefied natural gas is let down in three stages in order to enable storing liquefied natural gas at atmospheric pressure. The three stages yield three streams of gaseous natural gas. The three streams of natural gas used for liquefying the natural gas are compressed in a compression apparatus to liquefaction pressure and returned to the natural gas feed upstream of the main heat exchanger.

The compression apparatus used in the propane circuit is a single compressor comprising three sections. The compressor has a main inlet, two side inlets and one outlet for refrigerant at refrigeration pressure. The main inlet is the inlet for refrigerant at low pressure, the first side inlet is the inlet for refrigerant at intermediate pressure and the second side inlet is the inlet for refrigerant at high pressure.

The compression apparatus used in the ethylene circuit comprises two compressors in series, a first compressor having two sections and a second compressor having one section. The first compressor has a main inlet, a side inlet and one outlet for refrigerant at high pressure, wherein the main inlet is the inlet for refrigerant at low pressure and the side inlet is the inlet for refrigerant at intermediate pressure. The second compressor, having only one section, has a main inlet for refrigerant at high pressure and an outlet for refrigerant at refrigeration pressure. The first and second compressor are interconnected.

The compression apparatus used in the methane circuit comprises three compressors in series, wherein each compressor consists of a single section.

An alternative to the cascade-type liquefaction plant is the so-called propane-precooled multicomponent refrigerant liquefaction plant. Such a plant has a multi-stage propane pre-cooling circuit that is of the kind as described above with reference to the first two refrigerant circuits. In stead of propane, the multi-component refrigerant can be pre-cooled by multicomponent refrigerant. An example of such a plant is disclosed in U.S. Pat. No. 5,832,745. The apparatus for compressing the multi-component refrigerant is also a three-section compressor.

The amount of cooling provided per unit of time in the refrigeration circuit is proportional to the mass flow rate of the refrigerant that is circulated through the refrigeration circuit. With increasing amounts of natural gas to be liquefied the mass flow rate of the refrigerant has to increase. Although an increasing mass flow rate does not affect the number of impellers, it has an effect on the size of the impellers, on the diameter of the housing, and on the inlet velocity into the impellers. Because the latter variables increase with increasing flow rate, an increasing flow rate will result in a larger compressor and higher inlet velocities. Moreover, increasing the diameter of the housing of the compressor requires a thicker wall of the housing. Consequently the compressor is more difficult to manufacture and more difficult to handle.

SUMMARY OF THE INVENTION

It is an object of the present invention to provide an apparatus for compressing gaseous refrigerant that overcomes this drawback.

DETAILED DESCRIPTION OF THE INVENTION

To this end the present invention provides an apparatus for compressing gaseous refrigerant for use in a refrigeration circuit of a liquefaction plant, which refrigeration circuit has an inlet for refrigerant at a refrigeration pressure, a first outlet for gaseous refrigerant at a low pressure, a second outlet for gaseous refrigerant at an intermediate pressure and a third outlet for gaseous refrigerant at a high pressure, which apparatus comprises according to the present invention a first compressor and a second compressor, wherein the first compressor has a main inlet for receiving the refrigerant from the first outlet, a side inlet for receiving the refrigerant from the third outlet and an outlet that can be connected to the inlet of the refrigeration circuit, and wherein the second compressor has a main inlet for receiving the refrigerant from the second outlet and an outlet that can be connected to the inlet of the refrigeration circuit.

The problems relating to the compressor size are even more pronounced with more recent liquefaction plants where the refrigerant is allowed to evaporate in four heat exchangers in series.

For this reason the invention further relates to an apparatus for compressing gaseous refrigerant for use in a refrigeration circuit of a liquefaction plant, which refrigeration circuit has an inlet for refrigerant at a refrigeration pressure, a first outlet for gaseous refrigerant at a low pressure, a second outlet for gaseous refrigerant at an intermediate pressure, a third outlet for gaseous refrigerant at a high pressure and a fourth outlet for gaseous refrigerant at a high—high pressure, which apparatus comprises according to the present invention a first compressor and a second compressor, wherein the first compressor has a main inlet for receiving the refrigerant from the first outlet, a side-inlet for receiving the refrigerant from the third outlet and an outlet that can be connected to the inlet of the refrigeration circuit, and wherein the second compressor has a main inlet for receiving the refrigerant from the second outlet, a side-inlet for receiving the refrigerant from the fourth outlet and an outlet that can be connected to the inlet of the refrigeration circuit.

BRIEF DESCRIPTION OF THE FIGURES

The invention will now be described by way of example in more detail with reference to the accompanying drawings, wherein.

DETAILED DESCRIPTION OF THE FIGURES

Figure 1:
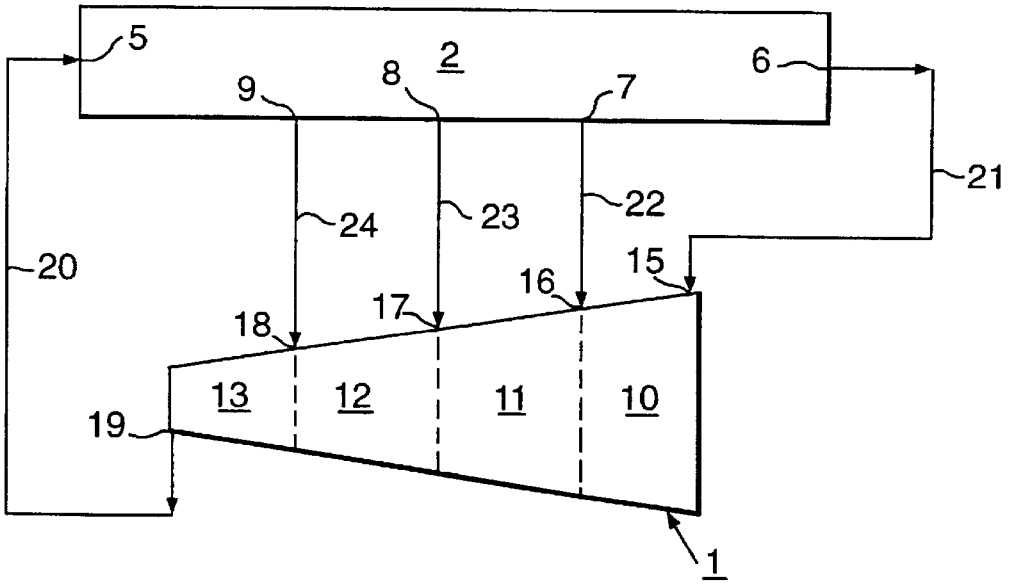
FIG. 1 shows a schematically a refrigeration circuit including a conventional compressor having four sections.

Reference is made to FIG. 1 showing schematically a compressor 1 for use in a refrigeration circuit represented by a box 2. Since the refrigeration circuit is well known, it is here only schematically shown for the sake of clarity.

The refrigeration circuit 2 has an inlet 5 for refrigerant at a refrigeration pressure, a first outlet 6 for gaseous refrigerant at a low pressure, a second outlet 7 for gaseous refrigerant at an intermediate pressure, a third outlet 8 for gaseous refrigerant at a high pressure and a fourth outlet 9 for gaseous refrigerant at a high—high pressure.

The compressor 1 has four sections 10, 11, 12 and 13 arranged in a single housing, which sections are interconnected. Each section can comprise one or more impellers, wherein an impeller is sometimes referred to as a stage. The compressor 1 has a main inlet 15, three side inlets 16, 17 and 18, and an outlet 19. The main inlet 15 opens into the low pressure section 10, the first side inlet 16 opens into the intermediate pressure section 11, the second side inlet 17 into the high pressure section 12, and the third side inlet 18 into the high—high pressure section 13. For the sake of clarity the driver of the compressor is not shown.

The outlet 19 of the compressor 1 is connected to the inlet 5 of the refrigeration circuit 2 by means of conduit 20. The first outlet 6 of the refrigeration circuit 2 is connected to the main inlet 15 of the compressor 1 by means of conduit 21, the second outlet 7 is connected to the first side inlet 16 by means of conduit 22, the third outlet 8 is connected to the second side inlet 17 by means of conduit 23 and the fourth outlet 9 is connected to the third side inlet 18 by means of conduit 24.

During normal operation, the compressor 1 compresses the refrigerant to a refrigeration pressure, wherein the refrigeration pressure is the pressure at which the refrigerant is supplied via conduit 20 to the inlet 5 of the refrigeration circuit 2. In four heat exchangers (not shown) in series the refrigerant is allowed to evaporate. In the first heat exchanger the refrigerant is allowed to partly evaporate at a high—high pressure, which is below the refrigeration pressure; the liquid part of the refrigerant is passed to the second heat exchanger and the remaining vapour (D kg/s) is returned to the compressor 1 through conduit 24. In the second heat exchanger the refrigerant is allowed to partly evaporate at a high pressure, which is below the high—high pressure; the liquid part of the refrigerant is passed to the third heat exchanger and the remaining vapour (C kg/s) is returned to the compressor 1 through conduit 23. In the third heat exchanger the refrigerant is allowed to partly evaporate at an intermediate pressure, which is below the high pressure; the liquid part of the refrigerant is passed to the forth heat exchanger and the remaining vapour (B kg/s) is returned to the compressor 1 through conduit 22. In the forth heat exchanger the refrigerant is allowed to evaporate at a low pressure, which is below the intermediate pressure, and the refrigerant leaving the forth heat exchanger (A kg/s) is returned to the compressor 1 through conduit 21.

In the low pressure section 10, A kg/s of refrigerant is compressed to the intermediate pressure. In the intermediate pressure section 11, A+B kg/s of refrigerant is compressed to the high pressure. In the high pressure section 12, A+B+C kg/s of refrigerant is compressed to the high—high pressure. In the high—high pressure section 13, A+B+C+D kg/s of refrigerant is compressed to the refrigeration pressure.

Figure 2:
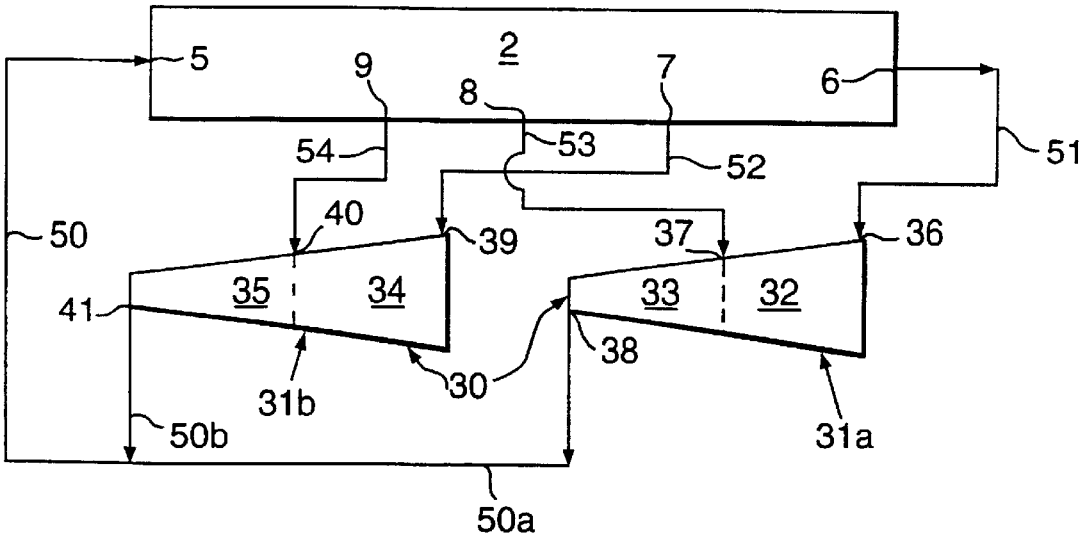
FIG. 2 shows schematically a refrigeration circuit including the compression apparatus according to the present invention having four sections.

Reference is now made to FIG. 2 showing schematically an apparatus 30 for compressing gaseous refrigerant according to the present invention for use in a refrigeration circuit. The refrigeration circuit and its inlet and outlets have been given the same reference numerals as in FIG. 1.

The apparatus 30 for compressing gaseous refrigerant comprises a first compressor 31*a* and a second compressor 31*b*, each compressor 31*a* and 31*b* being arranged in a single housing. The first compressor 31*a* has two interconnected sections 32 and 33, and the second compressor 31*b* has two interconnected sections 34 and 35. Each section can comprise one or more impellers. The sections 32, 33, 34 and 35 are referred to as the low pressure sections 32 and 34 and the high pressure sections 33 and 35.

The first compressor 31*a* has a main inlet 36, a side inlet 37, and an outlet 38. The second compressor 31*b* has a main inlet 39, a side inlet 40 and an outlet 41. The main inlet 36 of the first compressor 31*a* opens into the low pressure section 32, and the side inlet 37 opens into the high pressure section 33. The main inlet 39 of the second compressor 31*b* opens into the low pressure section 34, and the side inlet 40 opens into the high pressure section 35. For the sake of clarity the drivers of the compressors are not shown.

The outlets 38 and 41 of the compressors 31*a* and 31*b* are connected to the inlet 5 of the refrigeration circuit 2 by means of conduits 50, 50*a* and 50*b*. The first outlet 6 of the refrigeration circuit 2 is connected to the main inlet 36 of the first compressor 31*a* by means of conduit 51, and the second outlet 7 is connected to the main inlet 39 of the second compressor 31*b* by means of conduit 52. The third outlet 8 is connected to side inlet 37 of the first compressor 31*a* by means of conduit 53, and the fourth outlet 9 is connected to the side inlet 40 of the second compressor 31*b* by means of conduit 54.

During normal operation, the two compressors 31*a* and 31*b* each compress a part of the refrigerant to the refrigeration pressure, so that all refrigerant is supplied at the refrigeration pressure via conduits 50, 50*a* and 50*b* to the inlet 5 of the refrigeration circuit 2. In four heat exchangers (not shown) in series the refrigerant is allowed to evaporate. In the first heat exchanger the refrigerant is allowed to partly evaporate at a high—high pressure, which is below the refrigeration pressure; the liquid part of the refrigerant is passed to the second heat exchanger and the remaining vapour (D kg/s) is returned to the second compressor 31*b* through conduit 54. In the second heat exchanger the refrigerant is allowed to partly evaporate at a high pressure, which is below the high—high pressure; the liquid part of the refrigerant is passed to the third heat exchanger and the remaining vapour (C kg/s) is returned to the first compressor 31*a* through conduit 53. In the third heat exchanger the refrigerant is allowed to partly evaporate at an intermediate pressure, which is below the high pressure; the liquid part of the refrigerant is passed to the forth heat exchanger and the remaining vapour (B kg/s) is returned to the second compressor 31*b* through conduit 52. In the forth heat exchanger the refrigerant is allowed to evaporate at a low pressure, which is below the intermediate pressure, and the refrigerant leaving the forth heat exchanger (A kg/s) is returned to the first compressor 31*a* through conduit 51.

In the low pressure section 32 of the first compressor 31*a,* A kg/s of refrigerant is compressed to the high pressure, and in the high pressure section 33, A+C kg/s of refrigerant is compressed to the refrigeration pressure. In the low pressure section 34 of the second compressor 31*b,* B kg/s of refrigerant is compressed to the high—high pressure, and in the high pressure section 35, B+D kg/s of refrigerant is compressed to the refrigeration pressure.

A comparison between the compressors discussed with reference to FIGS. 1 and 2 shows that that the low pressure section 10 of compressor 1 corresponds to the low pressure section 32 of the first compressor 31*a,* and that the high—high pressure section 13 corresponds to the high pressure section 35 of the second compressor 31*b.* However, because of the different line-up, the intermediate pressure section 11 corresponds to the low pressure section 34 of the second compressor 31*b,* and the high pressure section 12 corresponds to the high pressure section 33 of the first compressor 31*a.*

The differences in mass flow rates in the conventional four-section compressor and the apparatus for compressing gaseous refrigerant according to the present invention will now be summarized in the below Table.

TABLE

Differences in mass flow rate through the sections of the compressors.

| Section | Conventional compressor | Invention |
|---|---|---|
| low pressure | A | A |
| intermediate pressure | A + B | B |
| high pressure | A + B + C | A + C |
| high-high pressure | A + B + C + D | B + D |

An advantage of the compression apparatus according to the present invention is that in the three sections following the low pressure section the mass flow rates are smaller. Consequently the volumetric flow rates in these sections are smaller.

In case the refrigeration circuit only includes three heat exchangers, the compression apparatus comprises three sections. Two of the three sections are arranged in the first compressor and the second compressor is the third section. In that case the line-up is like the one shown in FIG. 2 except that conduit 54 is not present, and that there is no high pressure section 35.

The compressors in the apparatus according to the present invention are suitably axial compressors.

We claim:

1. Apparatus for compressing gaseous refrigerant for use in a refrigeration circuit of a liquefaction plant, which refrigeration circuit has an inlet for refrigerant at a refrigeration pressure, a first outlet for refrigerant at a low pressure, a second outlet for refrigerant at an intermediate pressure and a third outlet for refrigerant at a high pressure, which apparatus comprises a first compressor and a second compressor, wherein the first compressor has a main inlet for receiving the refrigerant from the first outlet, a side inlet for receiving the refrigerant from the third outlet and an outlet that can be connected to the inlet of the refrigeration circuit, and wherein the second compressor has a main inlet for receiving the refrigerant from the second outlet and an outlet that can be connected to the inlet of the refrigeration circuit.

2. Apparatus for compressing gaseous refrigerant for use in a refrigeration circuit of a liquefaction plant, which refrigeration circuit has an inlet for refrigerant at a refrigeration pressure, a first outlet for refrigerant at a low pressure, a second outlet for refrigerant at an intermediate pressure, a third outlet for refrigerant at a high pressure and a fourth outlet for refrigerant at a high—high pressure, which apparatus comprises a first compressor and a second compressor, wherein the first compressor has a main inlet for receiving the refrigerant from the first outlet, a side-inlet for receiving the refrigerant from the third outlet and an outlet that can be connected to the inlet of the refrigeration circuit, and wherein the second compressor has a main inlet for receiving the refrigerant from the second outlet, a side-inlet for receiving the refrigerant from the fourth outlet and an outlet that can be connected to the inlet of the refrigeration circuit.

* * * * *